US012636573B1

(12) United States Patent
Shi

(10) Patent No.: US 12,636,573 B1
(45) Date of Patent: May 26, 2026

(54) TETRA-LINK CHESS

(71) Applicant: Dongguan Hongyu Plastic Co., Ltd., Dongguan (CN)

(72) Inventor: Juying Shi, Dongguan (CN)

(73) Assignee: Dongguan Hongyu Plastic Co., Ltd., Dongguan (CN)

( * ) Notice: Subject to any disclaimer, the term of this patent is extended or adjusted under 35 U.S.C. 154(b) by 0 days.

(21) Appl. No.: 19/341,463

(22) Filed: Sep. 26, 2025

Related U.S. Application Data

(63) Continuation-in-part of application No. 18/956,076, filed on Nov. 22, 2024.

(51) Int. Cl.
*A63F 3/00* (2006.01)

(52) U.S. Cl.
CPC ..... *A63F 3/00094* (2013.01); *A63F 3/00261* (2013.01); *A63F 3/00634* (2013.01); *A63F 3/00643* (2013.01); *A63F 2003/0041* (2013.01); *A63F 2003/00637* (2013.01); *A63F 2003/00652* (2013.01)

(58) Field of Classification Search
CPC ..... A63F 3/00094; A63F 3/00261; A63F 3/00634; A63F 3/00643; A63F 2003/0041; A63F 2003/00637; A63F 2003/00652; A63F 2003/00826
See application file for complete search history.

(56) References Cited

U.S. PATENT DOCUMENTS

| | | | | |
|---|---|---|---|---|
| 5,236,383 | A | 8/1993 | Connelly | |
| 6,428,003 | B1 * | 8/2002 | Fondin | A63F 3/00094 273/287 |
| 9,944,209 | B1 * | 4/2018 | Carnevali | F16M 11/2028 |
| 10,161,429 | B2 * | 12/2018 | Goffman | F16M 11/10 |
| 12,185,875 | B2 * | 1/2025 | Zhao | A47J 43/0761 |
| 2013/0040532 | A1 * | 2/2013 | Khubani | A63H 3/02 446/369 |
| 2014/0159309 | A1 * | 6/2014 | Jiang | A63F 3/00634 273/271 |

(Continued)

OTHER PUBLICATIONS

"4 to score" game assembly by Costway (uploaded to YouTube by self-service fix on May 11, 2023 at https://www.youtube.com/watch?v=7RaRIggoj64)(hereinafter "Costway") (Year: 2023).*

(Continued)

*Primary Examiner* — Michael D Dennis
(74) *Attorney, Agent, or Firm* — Cooper Legal Group, LLC

(57) ABSTRACT

A tetra-link chess includes two base frames, a plurality of mounting plates, a plurality of pieces and a baffle, the two base frames are symmetrically erected on the ground, the plurality of mounting plates are stacked along a vertical direction, two ends of each mounting plate are respectively connected to the two base frames, each mounting plate is configured with an accommodation groove configured to accommodate the plurality of pieces, the accommodation groove penetrates a respective one mounting plate from top to bottom, a side wall of each mounting plate is configured with a plurality of display holes in communication with the accommodation groove, and the baffle is slidably arranged at a bottom of a lowermost mounting plate along a horizontal direction to receive the plurality of pieces.

11 Claims, 6 Drawing Sheets

(56) References Cited

U.S. PATENT DOCUMENTS

| | | | | |
|---|---|---|---|---|
| 2016/0236075 | A1* | 8/2016 | Liotta | A63F 3/00694 |
| 2021/0093944 | A1* | 4/2021 | Titelius | A63F 11/0002 |
| 2023/0338822 | A1* | 10/2023 | Su | A63F 3/00697 |

OTHER PUBLICATIONS

Non-Final Office Action received in corresponding U.S. Appl. No. 18/956,076, dated Jan. 17, 2025, 22 pages.
Final Office Action received in corresponding U.S. Appl. No. 18/956,076, dated Apr. 9, 2025, 13 pages.
Advisory Action received in corresponding U.S. Appl. No. 18/956,076, dated Jun. 3, 2025, 3 pages.
"4 to score" game assembly by Costway (uploaded to YouTube by self-service fix on May 11, 2023; URL: https://www.youtube.com/watch?v=7RaRIggoj64), 2023, 8 pages.

* cited by examiner

TETRA-LINK CHESS

CROSS-REFERENCE TO RELATED APPLICATIONS

This application is a continuation-in-part of U.S. patent application Ser. No. 18/956,076, filed on Nov. 22, 2024 and entitled "Tetra-link chess". The entire disclosure of U.S. patent application Ser. No. 18/956,076 is incorporated herein by reference.

TECHNICAL FIELD

The present application relates to the technical field of cards and board games, and in particular, to a tetra-link chess.

BACKGROUND ART

As a kind of strategy board game with a long history, tetra-link chess has been popular with global players since the 1940's. Its core playing method is simple and challenging, i.e., two players place pieces in turn on a 7×6 chessboard, with a goal of being the first player to connect four pieces in line in any direction (horizontal, vertical or diagonal).

However, a traditional tetra-link chess chessboard is of a planar grid. With the increasing emphasis on healthy lifestyles, the limitations to the traditional tetra-link chess appear, especially in promoting physical activities.

In addition, since the traditional tetra-link chess chessboard is of a planar grid, it must fit the size of the table, which limits the physical interactivity of the game. The players only need simple hand movements and lack of a full-body exercise during the game, which cannot meet the needs of modern people to pursue a healthy lifestyle.

SUMMARY

In order to satisfy the need of modern people to pursue a healthy lifestyle, the present application provides a tetra-link chess.

The tetra-link chess provided in the present application adopts the following technical solution.

A tetra-link chess includes two base frames, a plurality of mounting plates, a plurality of pieces and a baffle, the two base frames are symmetrically erected on the ground, the plurality of mounting plates are stacked along a vertical direction, two ends of the plurality of mounting plates are respectively connected to the two base frames, each of the plurality of mounting plates is configured with an accommodation groove configured to accommodate the plurality of pieces, the accommodation groove penetrates a respective one of the plurality of mounting plates from top to bottom, a side wall of each of the plurality of mounting plates is configured with a plurality of display holes in communication with the accommodation groove, and the baffle is slidably arranged at a bottom of a lowermost mounting plate of the plurality of mounting plates along a horizontal direction to receive the plurality of pieces.

Optionally, side walls of the two base frames opposite to each other are respectively configured with first holding recesses, the two ends of each of the plurality of mounting plates are provided with load bearing blocks, and each of the load bearing blocks is accommodated in a respective one of the first holding recesses of a respective one of the two base frames.

Optionally, a limit block is fixed on a recess wall of each of the first holding recesses, a limiting groove is defined on a side wall of each of the load bearing blocks, and the limit block is embedded in the limiting groove and abuts against a groove wall of the limiting groove.

Optionally, each of the plurality of mounting plates are formed by two plate bodies being assembled together, the two plate bodies are centrally symmetrical, each of the two plate bodies is provided with a plurality of groups of elastic snap hooks and a plurality of groups of snap grooves, and the plurality of groups of elastic snap hooks and the plurality of groups of snap grooves of the two plate bodies are connected with other.

Optionally, a post is fixed on each of the two base frames, the post extends along the vertical direction, each of the plurality of pieces is of an annular shape, and the post is configured to cooperate with the plurality of pieces, such that the plurality of pieces are positioned on the post.

Optionally, a sliding groove is defined at the bottom of the lowermost mounting plate, a side wall of the baffle is fixed with a sliding bar, the sliding bar is slidably arranged in the sliding groove along the horizontal direction, and the baffle is configured with a plurality of through-openings with a width adapted to a width of the accommodation groove.

Optionally, an interior of each of the two base frames is designed to be hollow, a light box is embedded in a side wall of each of the two base frames, and the light box is configured to provide light to a respective one of the two base frames.

Optionally, a plurality of LEDs are embedded inside the baffle, and the plurality of LEDs are arranged at intervals along the horizontal direction.

Optionally, each of the two base frames includes a seat body and a bar body, the bar body is vertically fixed on a top of the seat body, a cup holder is provided on the bar body, a clasp is fixed on a side wall of the cup holder, the clasp is configured to surround the bar body and be slidable along the vertical direction, a second holding recess is defined on a side wall of the bar body, and a bottom of the clasp abuts against a recess bottom of the second holding recess.

Optionally, an inner wall of the clasp is provided with a plurality of protrusions, and side walls of the plurality of protrusions abut against the side wall of the bar body.

Optionally, each of the plurality of pieces is centrally provided with a through-hole cavity, and an identification member is removably inserted into the through-hole cavity.

Optionally, each of the plurality of pieces is uniformly provided with a plurality of pressure relief vents along a circumferential wall of each of the plurality of pieces, the plurality of pressure relief vents communicate with an internal cavity of each of the plurality of pieces, and a plurality of integrally formed cylindrical connecting pins are symmetrically arranged on axial side walls of each of the plurality of pieces.

Optionally, a gravity sensor is fixedly disposed on a surface of the baffle, the gravity sensor is configured to contact the plurality of pieces, and the gravity sensor is electrically connected to the plurality of LEDs.

In summary, the present application includes at least one of the following beneficial technical effects.

1. By providing a plurality of mounting plates and annular pieces in combination with the positioned placement and load-bearing functions of the post, players may place pieces on the mounting plates of different heights, which increases the strategy and interest of the game. Additionally, the annular design of the pieces in cooperation with the post make the placement process of the pieces more stable and enhance the interaction and participation of the game.

2. The light box inside the base frame and the design of the LED inside the baffle provide additional light effects for the game, which not only beautifies the game environment, but also increases the visual appeal of the game, especially at night or in darker environments, where light effects may significantly enhance the entertainment and atmosphere of the game.
3. The slidable design of the baffle and the through-opening make it convenient to collect and arrange the pieces after the game is over, avoiding the problem of the pieces being scattered and lost. Additionally, the baffle may effectively prevent the pieces from accidentally sliding down during the game, which improves the security of the game, and ensures that the player's experience is not disturbed during the game.

DETAILED DESCRIPTION

The present application is described in further detail below referring to FIGS. 1-9.

Embodiment 1

Figure 1:
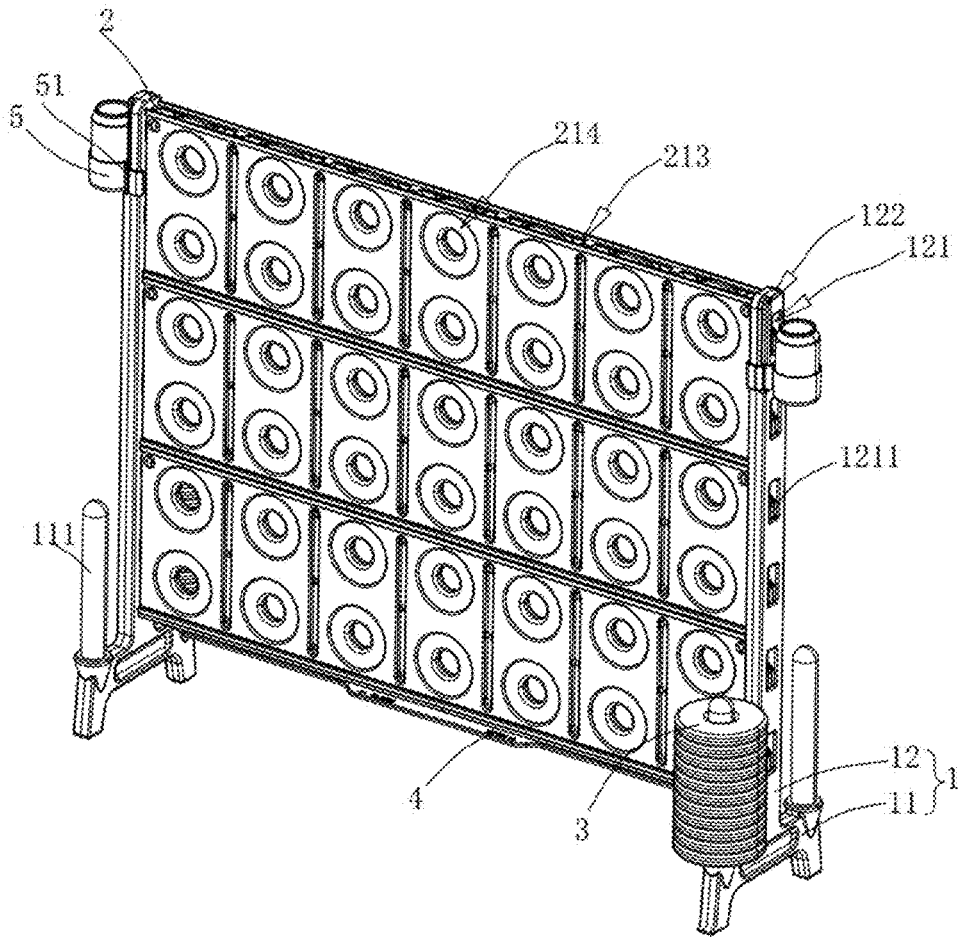
FIG. 1 is a schematic view showing the overall structure of a tetra-link chess according to Embodiment 1 of the present application.

The embodiment of the present application discloses a tetra-link chess. Referring to FIG. 1, the tetra-link chess includes base frames 1, mounting plates 2, a plurality of pieces 3 and a baffle 4. The base frames 1 are configured to carry the mounting plates 2, the pieces 3 and the baffle 4. The mounting plates 2 are used for placing pieces 3 to function as a chessboard. The baffle 4 is used to stop the pieces 3, to carry the pieces 3 together with the mounting plates 2.

In particular, two base frames 1 are provided, which are symmetrically arranged at intervals in the horizontal direction. The base frame 1 includes a seat body 11 and a bar body 12, where the bottom of the seat body 11 is erected on the ground via two support legs, the bar body 12 is correspondingly vertically fixed in the middle of the upper surface of the seat body 11, and the bar body 12 is integrally formed with the seat body 11.

Figure 2:
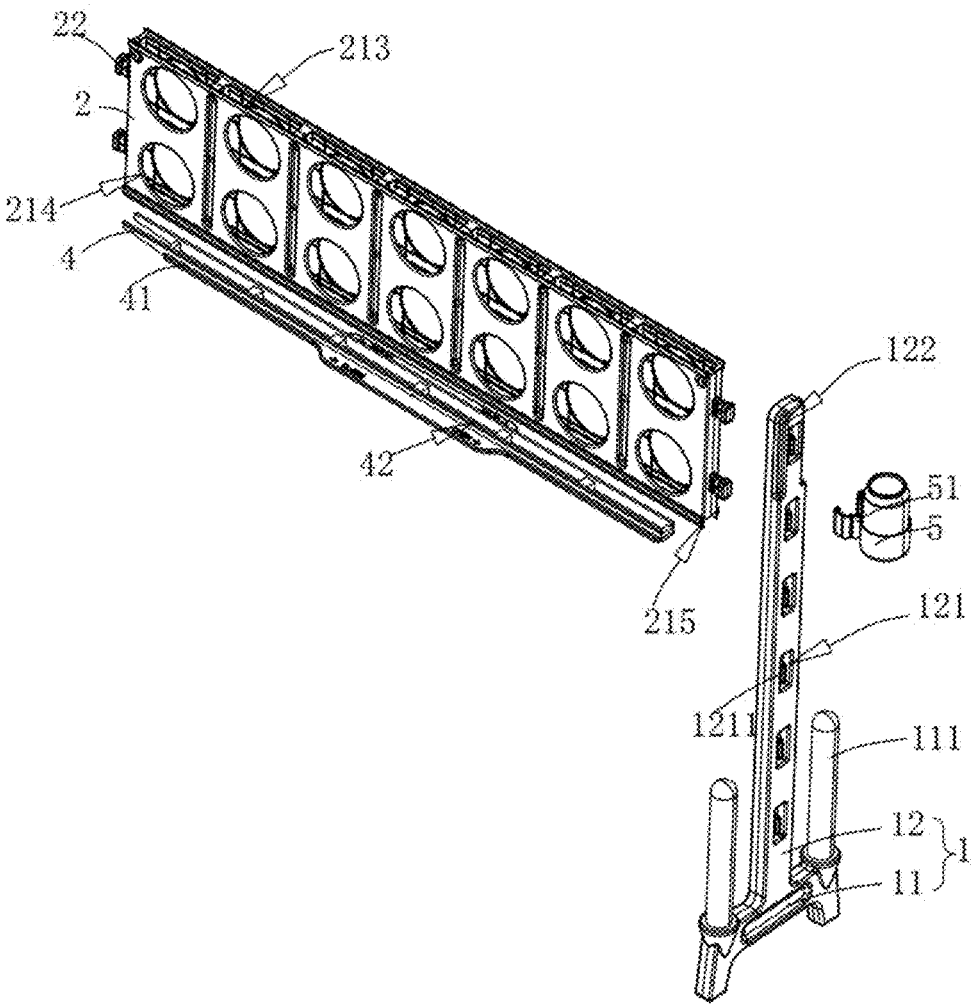
FIG. 2 is a schematic assembly diagram of a base frame, a mounting plate, and a cup holder of the tetra-link chess according to Embodiment 1 of the present application.

Referring to FIGS. 1 and 2, a plurality of mounting plates 2 are provided correspondingly, and the plurality of mounting plates 2 are spliced in a vertical direction to form a chessboard. Taking one of the mounting plates 2 as an example, two ends of the mounting plate 2 are respectively connected to two bar bodies 12. Specifically, side walls of the two bar bodies 12 are each configured with a first holding recess 121, the first holding recess 121 penetrates the left and right side walls of the corresponding bar body 12, and the first holding recess 121 is a strip-shaped groove extending along the vertical direction. Load bearing blocks 22 are respectively fixed at the two ends of the mounting plate 2 and are integrally formed with the mounting plate 2, and the two load bearing blocks 22 are respectively arranged in the first holding recesses 121 of the two bar bodies 12.

In the present embodiment, three mounting plates 2 are provided, and correspondingly, three first holding recesses 121 are defined in the bar body 12, and the three first holding recesses are arranged at intervals along the vertical direction. Optionally, one end of each mounting plate 2 is fixed with two load bearing blocks 22. Accordingly, six first holding recesses 121 are defined in the bar body 12, and the six first holding recesses 121 are arranged at intervals along the vertical direction, to enhance the mounting stability of the mounting plate 2 on the bar body 12.

Specifically, two recess walls of the first holding recess 121 opposite to each other are respectively fixed with a limit block 1211 integrally formed with the bar body 12, two side walls of the load bearing block 22 are respectively configured with a limiting groove, and the limit block 1211 is embedded in the limiting groove and abuts against the groove wall of the limiting groove. With the limiting grooves, the cross section of the load bearing block 22 is in a T shape, i.e., the width of a section of the load bearing block 22 is greater than the width of the other sections (specifically, the width of an end of the load bearing block 22 away from the mounting plate 2 is greater than the width of an end of the load bearing block 22 close to the mounting plate 2), and the width of the section of the load bearing block 22 is also greater than the distance between the opposite surfaces of the two limit blocks 1211 (specifically, the width of the end of the load bearing block 22 away from the mounting plate 2 is greater than the distance between the opposite surfaces of the two limit blocks 1211). The length of the limit block 1211 is less than the length of the first holding recess 121, and the limit block 1211 is arranged in the lower half region of the first holding recess 121 (and the end of the load bearing block 22 close to the mounting plate 2 is embedded between the opposite surfaces of the two limit blocks 1211).

Therefore, when the mounting plate 2 is mounted, the mounting plate 2 is moved laterally to the bar body 12, so that the load bearing block 22 is inserted into the first holding recess 121 until the section of a greater width of the load bearing block 22 passes above the limit block 1211 (at this moment, the limit block 1211 does not limit the load bearing block 22), then the mounting plate 2 is moved downwards until the bottom of the load bearing block 22 abuts against the recess wall of the first holding recess 121, such that the load bearing block 22 is accommodated by the first holding recess 121. Meanwhile, the load bearing block 22 is embedded in the limiting groove and abuts against the groove wall of the limiting groove (specifically, the end of the load bearing block 22 away from the mounting plate 2 abuts against the groove wall of the limiting groove, while the end of the load bearing block 22 close to the mounting plate 2 is embedded between the opposite surfaces of the two limit blocks 1211), such that the load bearing block 22 is limited by the limit block 1211 along the horizontal direction.

Therefore, during the assembly of the tetra-link chess, the mounting plate 2 is mounted smoothly and firmly due to the cooperation of the load bearing block 22 and the first holding recess 121 of the bar body 12. Specifically, the load bearing block 22 first approaches the bar body 12 laterally and is inserted into the first holding recess 121, and then moves downward until it completely abuts against the recess wall, at which time the load bearing block 22 is inserted into the limiting groove and abuts against the groove wall, which effectively limits the movement of the load bearing block 22 along the horizontal direction and ensures the stable fixation of the mounting plate 2 along the vertical direction. This design not only simplifies the conventional installation procedure using screws and nuts and improves the mounting efficiency, but also enhances the stability of the structure and ensures the safety and fluency during the game.

Figure 3:
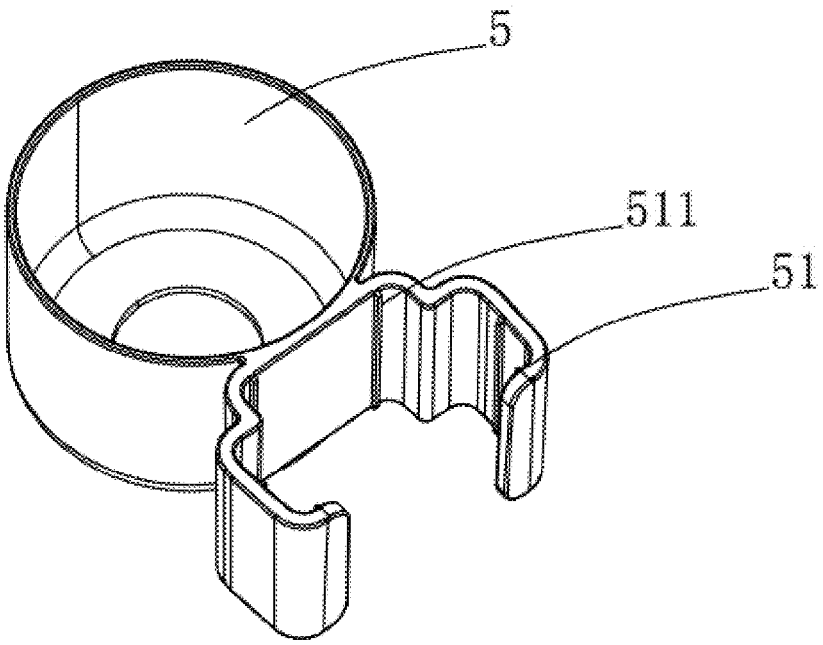
FIG. 3 is a schematic view showing the structure of the cup holder of the tetra-link chess according to Embodiment 1 of the present application.

Referring to FIGS. 1 and 3, on the other hand, the mounting plate 2 is formed by assembling two plate bodies 21, and the two plate bodies 21 are centrally symmetrical. Taking one of the plate bodies 21 as an example, the plate body 21 has a rectangular parallelepiped shape, and the plate body 21 is provided with a plurality of groups of elastic snap hooks 211 and a plurality of groups of snap grooves 212. Specifically, one plate body 21 is provided with three groups of elastic snap hooks 211 and three groups of snap grooves 212, where the three groups of elastic snap hooks 211 are orderly arranged along a length direction of the plate body 21, followed by the three groups of snap grooves 212, and finally the last group of elastic snap hooks 211 is arranged.

Specifically, each group of elastic snap hooks 211 includes three elastic snap hooks, the three elastic snap hooks 211 are arranged at intervals along the vertical direction, and the elastic snap hooks 211 are integrally formed with the plate body 21 and are molded by die casting in one step. Accordingly, each group of snap grooves 212 also includes three snap grooves, and the three snap grooves 212 at one plate body 21 are positioned corresponding to the three elastic snap hooks 211 on the other plate body 21. Furthermore, since the two plate bodies 21 are centrally symmetrical, the elastic snap hooks 211 on one plate body 21 is connected and fixed with the snap groove 212 on the other plate body 21, while the snap grooves 212 on the one plate body 21 correspondingly are also connected and fixed with the elastic snap hooks 211 on the other plate body 21 when assembling two plate bodies, thereby achieving the relative fixation of the two plate bodies 21.

It should be noted that the load bearing block 22 in the present application is also formed by assembling two plate bodies 21. Specifically, a central symmetry line of the T-shaped cross-section of the load bearing block 22 serves as its longitudinal division line. Each plate body 21 incorporates half of the load bearing block 22 divided by this longitudinal division line. When the two plate bodies 21 are joined together, they form a complete load bearing block 22.

Therefore, in the design of the mounting plate 2 of the tetra-link chess, the mounting plate 2 may be so quickly assembled and disassembled, that the two centrally symmetrical plate bodies 21 are assembled by means of the cooperation of the elastic snap hooks 211 and the snap grooves 212. By the three groups of elastic snap hooks 211 and the three groups of snap grooves 212 on each plate body 21, not only the accurate alignment when assembling two plate bodies 21 is ensured, but also the connection strength and stability between the plate bodies 21 is enhanced by means of the connection and fixation of the elastic snap hooks 211 and the snap grooves 212. This design not only simplifies the assembly process of the mounting plate 2, improves the assembly efficiency, but also ensures the structural security of the mounting plate 2 during use, thereby providing a more stable and convenient chessboard structure for the tetra-link chess game.

In addition, a plurality of accommodation grooves 213 are defined on the surface of the plate body 21, and the plurality of accommodation grooves 213 are arranged at intervals along the length direction of the plate body 21. In the present embodiment, seven accommodation grooves 213 are provided. When two plate bodies 21 are connected to form the mounting plate 2, the accommodation grooves 213 on the two plate bodies 21 are correspondingly combined to form an accommodation groove 213 with a larger volume, and the accommodation groove 213 is used for placing the pieces 3, i.e., is configured for placing a piece when moving a piece in a chessboard game.

Furthermore, the side wall of the plate body 21 is configured with a plurality of groups of display holes 214, and in the present embodiment, seven groups of display holes 214 are provided, and the seven groups of display holes 214 are positioned respectively corresponding to the seven accommodation grooves 213. Each group of display holes 214 has two display holes, and the two display holes 214 of one group are spaced apart along the vertical direction and communicate with the respective accommodation groove 213. Correspondingly, the piece 3 is of an annular shape, and the outer diameter of the piece 3 is greater than the hole diameter of the display hole 214, so that when the pieces 3 are placed in the accommodation groove 213 during the piece placing process, the display hole 214 may display whether pieces are placed on the corresponding chessboard region. In one accommodation groove 213, the pieces 3 above are correspondingly stacked on the pieces 3 below.

Therefore, in the chessboard design of the tetra-link chess, the pieces 3 are orderly placed and the game state is visually displayed by the accommodation grooves 213 on the surface and the display hole 214 on the side wall of the plate body 21. In particular, the seven accommodation grooves 213 on each plate body 21 form a larger accommodation space for accommodating piece 3, i.e., for a piece placing operation in a chessboard game when two plate bodies 21 are brought together. In addition, each group of the seven groups of display holes 214 on the side wall of the plate body 21 includes two holes at intervals along the vertical direction, which are positioned corresponding to the accommodation grooves 213, so as to visually display whether there are piece 3 in the accommodation groove 213. Since the piece 3 is of an annular shape and has an outer diameter greater than the hole diameter of the display hole 214, the upper piece 3 will be stacked on the lower piece 3 when the piece 3 is placed in the accommodation groove 213, thereby clearly displaying the piece distribution of each chessboard region, which enhances the interaction and interest of the game and also facilitates the player to observe the progress of the game, thereby improving the game experience.

Furthermore, since the above-mentioned accommodation groove 213 extends through the upper and lower surfaces of the mounting plate 2, it is necessary to act on the lowermost mounting plate 2 via the baffle 4 during assembly, thereby holding the lowermost piece 3 on the chessboard.

Figure 4:
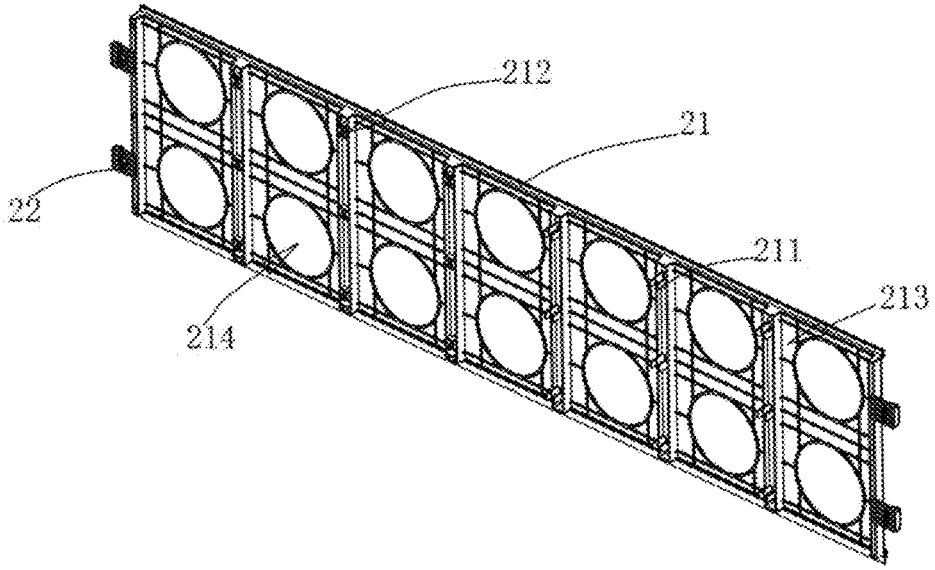
FIG. 4 is a schematic view showing the structure of a plate body of the tetra-link chess according to Embodiment 1 of the present application.

Referring to FIGS. 2 and 4, specifically, the bottom of the plate body 21 is configured with two sliding grooves 215, the side wall of the baffle 4 is correspondingly fixed with two sliding bars 41 which are slidable in the sliding grooves 215 along the horizontal direction. The baffle 4 is configured with a plurality of through-openings 42, and the width of the through-opening 42 is adapted to the width of the accommodation groove 213.

Therefore, the operation principle of the baffle 4 by the chessboard structure of the tetra-link chess is to realize the slidable mounting of the baffle 4 along the horizontal direction by the sliding bars 41 on the side wall thereof in cooperation with the sliding grooves 215 on the bottom of the plate body 21. When the baffle 4 is in place, the through-openings 42 thereon are aligned with the accommodation grooves 213, the pieces 3 may fall out of the mounting plate 2 from the through-openings 42 because the width of the through-opening 42 is adapted to the width of the accommodation groove 213, so as to realize the reset of the chessboard. When the baffle 4 is again controlled to slide horizontally over a distance, the through-opening 42 is staggered from the accommodation groove 213, and the baffle 4 may close the groove opening at the bottom of the accommodation groove 213, thereby ensuring that the baffle 4 may accurately receive the lowermost piece 3, so as to prevent the piece 3 from falling out of the accommodation groove 213 due to gravity or an external force.

On the other hand, in order to further improve the convenience of using the tetra-link chess, the present application also adopts the following solution.

Referring to FIGS. 2 and 3, specifically, the bar body 12 is detachably connected with a cup holder 5, the side wall of the cup holder 5 is fixed with a clasp 51, and the clasp 51 clasps the bar body 12 and is slidable along the vertical direction. The side wall of the bar body 12 is configured with a second holding recess 122, and the bottom of the clasp 51 abuts against the recess bottom of the second holding recess 122. The clasp 51 is integrally formed with the cup holder 5, and the clasp 51 has a certain elasticity and is semi-annular, i.e., the clasp 51 may be elastically deformed to be wound around the periphery of the bar body 12 to realize the detachable arrangement of the cup holder 5.

Thus, the detachable connection mechanism of the cup holder 5 in the present chessboard of the tetra-link chess is achieved by the cooperation of the clasp 51 with the bar body 12. Specifically, the clasp 51 is fixed on the side wall of the cup holder 5, is semi-annular and has a certain elasticity. The clasp 51 may be elastically deformed to wrap around the periphery of the bar body 12, thereby realizing a quick mounting of the cup holder 5. Additionally, the bottom of the clasp 51 abuts against the recess bottom of the second holding recess 122 on the side wall of the bar body 12, which ensures a stable positioning of the cup holder 5 along the vertical direction. This design not only simplifies the assembling and disassembling process of the cup holder 5, but also ensures the stability of the cup holder 5 during use, which facilitates the placement of beverages or small objects by the player in the interval of the game, thereby improving the convenience and comfort of the game. The clasp 51 is integrally formed with the cup holder 5 to ensure compactness and durability of the structure while also facilitating mass production and cost control.

The inner wall of the clasp 51 is provided with a plurality of protrusions 511. Side walls of the plurality of protrusions 511 abut against the side wall of the bar body 12. Optionally, the inner wall of the clasp 51 is provided with four protrusions 511, the four protrusions 511 are distributed at circumferential intervals. The protrusions 511 extend inward from the inner wall of the clasp 51 toward the center, and their side walls are configured to directly abut against the side wall of the bar body 12 when it is inserted into the clasp 51.

Correspondingly, the protrusions 511 are made of a material with certain elasticity and strength, or the entire clasp 51 is made of such a material. When the bar body 12 is inserted into the clasp 51, the side walls of the protrusions 511 form an interference fit with the side wall of the bar body 12, thereby clamping the bar body. This multi-point interference clamping structure formed by the plurality of protrusions 511 (particularly the four protrusions 511) significantly increases the contact area and friction between the bar body 12 and the clasp 51. This enables the clasp to securely clamp the bar body 12, effectively restricting radial movement and wobbling of the bar body 12 within the clasp 51, thereby ensuring a stable clamping state and significantly reducing the likelihood of instability after engagement.

Further, a plurality of posts 111 are vertically fixed with the upper surface of the seat body 11, and the posts 111 are integrally formed with the seat body 11. The post 111 extends along the vertical direction, the piece 3 is of an annular shape, and the post 111 is adapted to cooperate with the piece 3 so that the piece 3 may be positioned thereon.

The implementation principle of the tetra-link chess in the embodiments of the present application is as follows.

Through the cooperation of the base frames 1, the mounting plates 2, the pieces 3 and the baffle 4, the pieces 3 may be stably held and conveniently operated. The base frames 1 are symmetrical to each other and are erected on the ground, to support a plurality of mounting plates 2 stacked along the vertical direction, where the mounting plates 2 are each provided with an accommodation groove 213 to accommodate the pieces 3, to ensure the positioned placement of the pieces 3. The baffle 4 is slidable at the bottom of the lowermost mounting plate 2 along the horizontal direction. The baffle 4 may be slidably assembled by the sliding bars 41 on the side wall in cooperation with the sliding grooves 215 at the bottom of the mounting plate 2. The through-opening 42 on the baffle is adapted to the width of the accommodation groove 213, so that the baffle 4 may precisely receive the lowermost piece 3 when the through-opening 42 of the baffle 4 is misaligned with the accommodation groove 213 of the mounting plate 2, thereby preventing the piece 3 from falling out of the accommodation groove 213 due to gravity or an external force. In addition, the post 111 on the base frame 1 cooperates with the annular pieces 3 to position the pieces 3 on the post 111.

Embodiment 2

Figure 5:
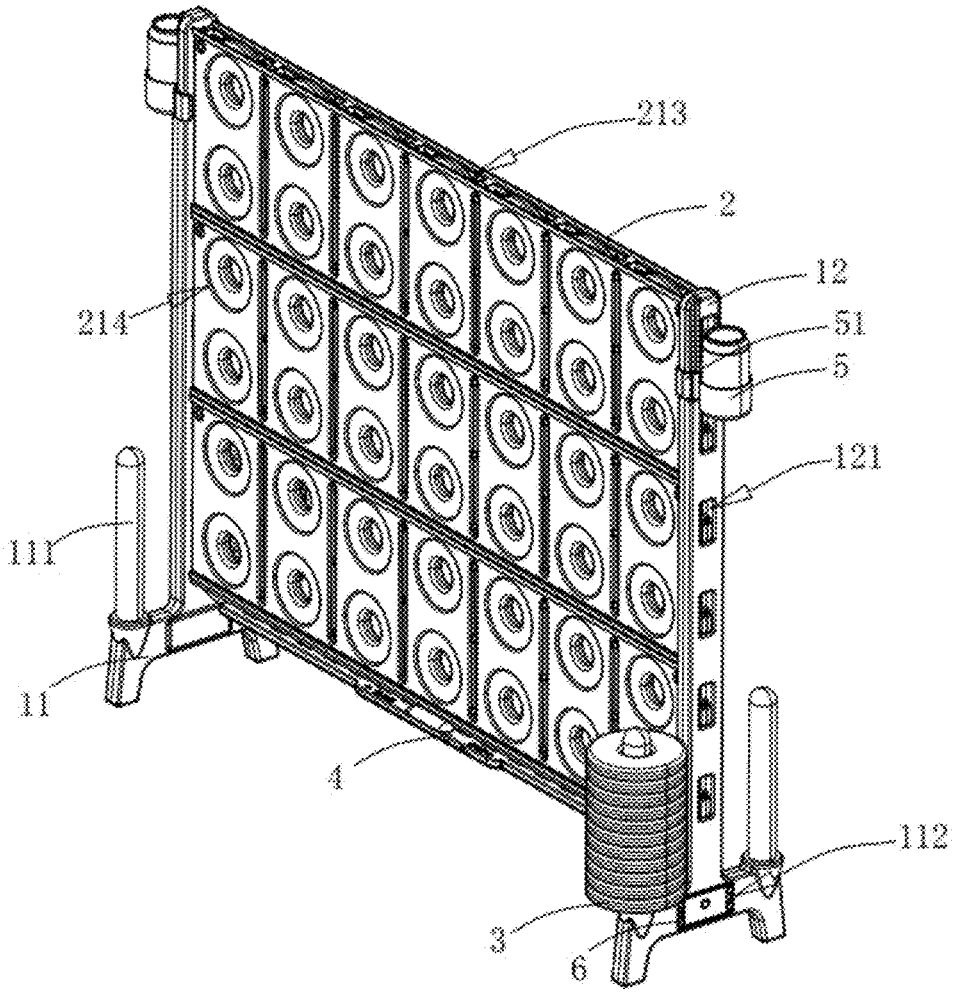
FIG. 5 is a schematic view showing the overall structure of a tetra-link chess according to Embodiment 2 of the present application.

Referring to FIG. 5, the present embodiment differs from Embodiment 1 in that the seat body 11 and the bar body 12 are configured with a hollow structure, and the internal regions of the seat body 11 and the bar body 12 are interconnected. A light box 6 is embedded in the side wall of the seat body 11 to provide lighting for the base frame 1. The side wall of the seat body 11 is configured with a mounting groove 112 that communicates with the internal region of the seat body 11. The light box 6 is secured within the mounting groove 112 via bolts.

Figure 6:
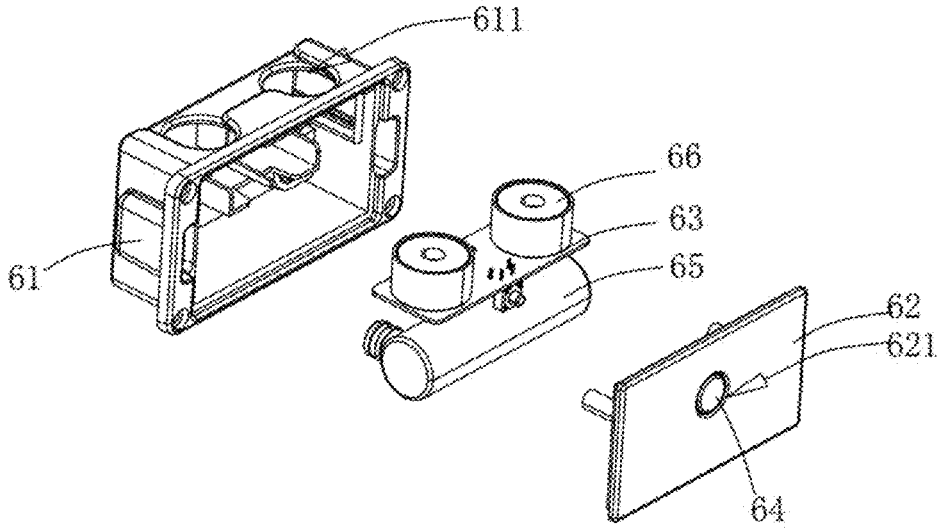
FIG. 6 is an exploded view of a light box in the tetra-link chess according to Embodiment 2 of the present application.

Referring to FIGS. 5 and 6, specifically, the light box 6 includes a housing 61, a cover 62, a control circuit board 63, a switch button 64, a battery 65, and a lamp body 66. The housing 61 has one open side, and the cover 62 is configured to cover the open side of the housing 61 and be clamped in the housing 61. The control circuit board 63, the switch button 64, the battery 65, and the lamp body 66 are electrically connected. The control circuit board 63 is built into the housing 61. The battery 65 is detachably mounted within the housing 61. Both the lamp body 66 and the switch button 64 are installed on the control circuit board 63. A surface of the cover 62 is formed with a through hole 621 for the switch button 64 to extend through. A side wall of the housing 61 is provided with a light hole 611. The position of the light hole 611 corresponds to that of the lamp body 66, allowing the light from the lamp body 66 to pass through the light hole 611 into the interior of the seat body 11 and the bar body 12, thereby creating a lighting effect on the surfaces of the seat body 11 and the bar body 12.

Figure 7:
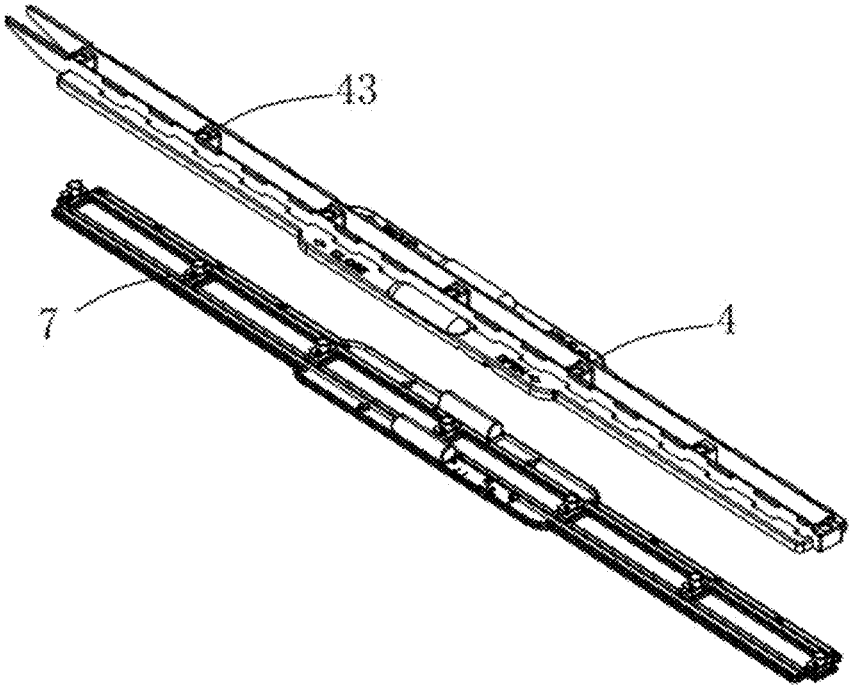
FIG. 7 is a schematic assembly diagram of a plate body and a LED in the tetra-link chess according to Embodiment 2 of the present application.

Referring to FIGS. 5 and 7, furthermore, the baffle 4 is embedded with several LEDs 7 arranged at intervals along the horizontal direction. The LEDs 7 are fixed to the inner wall of the baffle 4, and the light of the LEDs 7 illuminates the inner surface of the baffle 4, thereby causing the outer surface of the baffle 4 to exhibit a lighting effect.

Furthermore, a gravity sensor 43 is fixedly disposed on the surface of the baffle 4 facing the placement area of the piece 3. The sensing surface of the gravity sensor 43 is configured to directly contact the bottom of a piece 3 placed on the baffle 4. The gravity sensor 43 is electrically connected to adjacent LEDs 7 via wires or PCB traces. When a piece 3 is placed at a specific position on the baffle 4, its weight is applied to the gravity sensor 43.

The gravity sensor 43 is configured to detect changes in the weight of objects placed on it. When a piece 3 is detected to be placed on the gravity sensor (i.e., the gravitational value changes from zero to presence or shows a significant increase), the gravity sensor 43 generates a trigger signal. This trigger signal is transmitted to the electrically connected LED 7, activating its circuit and causing the LED 7 to illuminate. Conversely, when the piece 3 is removed, and the gravity sensor 43 detects the disappearance or a significant decrease in weight, it ceases to output the trigger signal. This results in the disconnection of the LED's 7 circuit, turning off the illumination. This gravity-based triggering mechanism ensures that the LEDs 7 operate only when a piece 3 is actually placed, significantly reducing power consumption during non-use periods.

The hollow design and embedded light box 6 inside the base frame 1 of the present embodiment, as well as the embedded LEDs 7 inside the baffle 4 provide a light effect for the game, which enhances the visual experience of the game.

Embodiment 3

Figure 8:
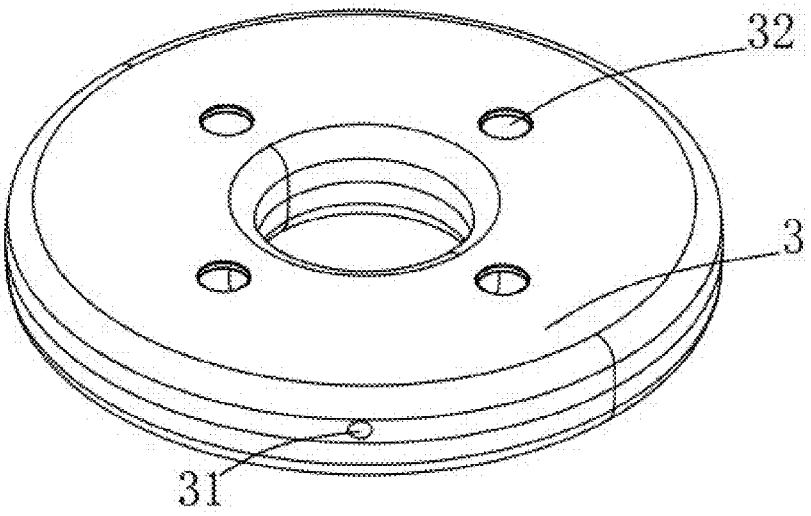
FIG. 8 is a schematic view showing the structure of a piece according to Embodiment 3 of the present application.

Referring to FIG. 8, this embodiment differs from other embodiments in that the piece 3 is uniformly provided with a plurality of pressure relief vents 31 along its circumferential wall. These pressure relief vents 31 penetrate the circumferential wall of the piece 3, directly connecting its internal sealed cavity with the external environment. When the piece 3 is exposed to high outdoor temperatures (such as direct sunlight), the internal air expands due to heat, causing an increase in air pressure. At this time, hot air is continuously discharged outward through the pressure relief vents 31, achieving a dynamic pressure balance.

Furthermore, four integrally formed cylindrical connecting pins 32 are symmetrically arranged on two axial side walls of the piece 3. These connecting pins 32 form an internal support framework that generates continuous tensile stress on the two axial side walls, counteracting the tendency for radial expansion when the two axial side walls soften due to heat. Their multipoint symmetric layout (with the four pins distributed at 90° intervals circumferentially) ensures uniform stress transmission, significantly enhancing the structural rigidity of the piece.

Thus, the pressure relief vents 31 and the connecting pins 32 form a collaborative protective mechanism: the pressure relief vents 31 reduce the internal pressure through air exchange, suppressing outward bulging of the piece 3; while the connecting pins 32 resist inward collapse and circumferential deformation of the piece 3 through internal constraints. This solves the problem of traditional hollow pieces 3 jamming due to expansion after sun exposure and becoming unable to be inserted into the board slots.

Furthermore, the connecting pins 32 are formed by directly pressing the shell surface of the piece 3. Through protruding structures in the injection mold, the shell material of the piece is reversely bulged into the internal cavity, forming four cylindrical connecting pins 32 that are integrally formed with the main body of the piece 3. These recess-formed connecting pins 32 constitute a cross-shaped support frame inside the shell of the game piece, achieving tensile locking of the two axial side walls without adding additional components, thereby eliminating the risk of stress concentration associated with traditional adhesive-connected pins.

Embodiment 4

Figure 9:
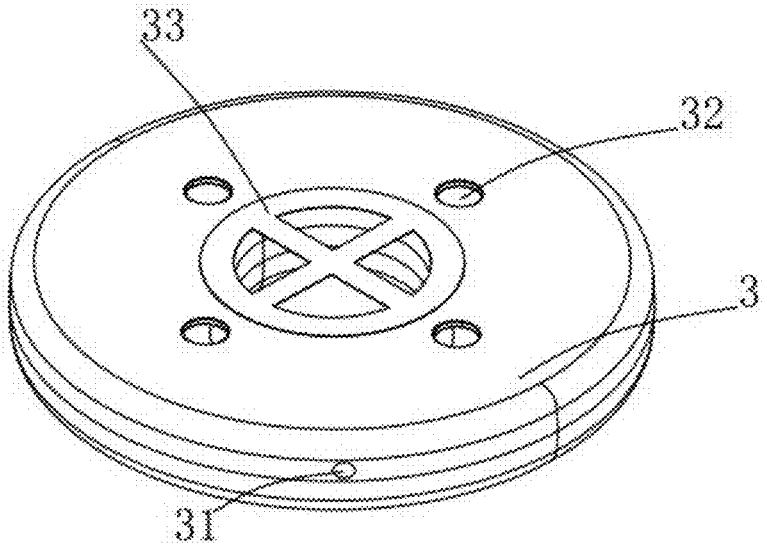
FIG. 9 is a schematic view showing the structure of a piece according to Embodiment 4 of the present application.

Referring to FIG. 9, this embodiment differs from other embodiments in that the piece 3 is centrally provided with a through-hole cavity, and an identification member 33 is removably inserted into this through-hole cavity. The exposed surface of the identification member 33 features non-color recognition marks formed by differentiated three-dimensional shapes (such as prisms or stars) and tactile textures (such as bumps or grooves), and is assembled flush with the shell surface of the piece 3.

Correspondingly, the combination of physical characteristics of the identification member 33 enables users with color vision deficiencies to distinguish the type of piece 3 solely through visual shape reflection or tactile textures, overcoming the limitations of traditional color-coding systems.

The above-mentioned embodiments of the present application are not intended to limit the protection scope of the present application, and therefore all equivalent variations in the structure, shape, and principles of the present application are within the protection scope of the present application.

LIST OF REFERENCE SIGNS

1 base frame
11 seat body
111 post
112 mounting groove
12 bar body
121 first holding recess
1211 limit block
122 second holding recess
2 mounting plate
21 plate body
211 elastic snap hook
212 snap groove
213 accommodation groove
214 display hole
215 sliding groove

22 load bearing block
3 piece
31 pressure relief vent
32 connecting pin
33 identification member
4 baffle
41 sliding bar
42 through-opening
43 gravity sensor
5 cup holder
51 clasp
511 protrusion
6 light box
61 housing
611 light hole
62 cover
621 through hole
63 control circuit board
64 switch button
65 battery
66 lamp body
7 LED

What is claimed is:

1. A tetra-link chess, comprising two base frames, a plurality of mounting plates, a plurality of pieces and a baffle, wherein the two base frames are symmetrically erected on ground, the plurality of mounting plates are stacked along a vertical direction, two ends of each of the plurality of mounting plates are respectively connected to the two base frames, each of the plurality of mounting plates is configured with an accommodation groove configured to accommodate the plurality of pieces, the accommodation groove penetrates a respective one of the plurality of mounting plates from top to bottom, a side wall of each of the plurality of mounting plates is configured with a plurality of display holes in communication with the accommodation groove, the baffle is slidably arranged at a bottom of a lowermost mounting plate of the plurality of mounting plates along a horizontal direction to receive the plurality of pieces, each of the plurality of pieces is uniformly provided with a plurality of pressure relief vents along a circumferential wall of each of the plurality of pieces, the plurality of pressure relief vents communicate with an internal cavity of each of the plurality of pieces, and a plurality of integrally formed cylindrical connecting pins are symmetrically arranged on axial side walls of each of the plurality of pieces.

2. The tetra-link chess according to claim 1, wherein side walls of the two base frames opposite to each other are respectively configured with first holding recesses, the two ends of each of the plurality of mounting plates are provided with load bearing blocks, and each of the load bearing blocks is accommodated in a respective one of the first holding recesses of a respective one of the two base frames.

3. The tetra-link chess according to claim 2, wherein each of the two base frames comprises a seat body and a bar body, the bar body is vertically fixed on a top of the seat body, a cup holder is provided on the bar body, a clasp is fixed on a side wall of the cup holder, the clasp is configured to surround the bar body and be slidable along the vertical direction, a second holding recess is defined on a side wall of the bar body, and a bottom of the clasp abuts against a recess bottom of the second holding recess.

4. The tetra-link chess according to claim 3, wherein an inner wall of the clasp is provided with a plurality of protrusions, and side walls of the plurality of protrusions abut against the side wall of the bar body.

5. The tetra-link chess according to claim 1, wherein each of the plurality of mounting plates is formed by two plate bodies being assembled together, the two plate bodies are centrally symmetrical, each of the two plate bodies is provided with a plurality of groups of elastic snap hooks and a plurality of groups of snap grooves, and the plurality of groups of elastic snap hooks and the plurality of groups of snap grooves of the two plate bodies are connected with other.

6. The tetra-link chess according to claim 1, wherein a post is fixed on each of the two base frames, the post extends along the vertical direction, each of the plurality of pieces is of an annular shape, and the post is configured to cooperate with the plurality of pieces, such that the plurality of pieces are positioned on the post.

7. The tetra-link chess according to claim 1, wherein a sliding groove is defined at the bottom of the lowermost mounting plate, a side wall of the baffle is fixed with a sliding bar, the sliding bar is slidably arranged in the sliding groove along the horizontal direction, and the baffle is configured with a plurality of through-openings with a width adapted to a width of the accommodation groove.

8. The tetra-link chess according to claim 1, wherein an interior of each of the two base frames is hollow, a light box is embedded in a side wall of each of the two base frames, and the light box is configured to provide light to a respective one of the two base frames.

9. The tetra-link chess according to claim 1, wherein a plurality of light emitting diodes (LEDs) are embedded inside the baffle, and the plurality of LEDs are arranged at intervals along the horizontal direction.

10. The tetra-link chess according to claim 1, wherein each of the plurality of pieces is centrally provided with a through-hole cavity, and an identification member is removably inserted into the through-hole cavity.

11. A tetra-link chess, comprising two base frames, a plurality of mounting plates, a plurality of pieces and a baffle, wherein the two base frames are symmetrically erected on ground, the plurality of mounting plates are stacked along a vertical direction, two ends of each of the plurality of mounting plates are respectively connected to the two base frames, each of the plurality of mounting plates is configured with an accommodation groove configured to accommodate the plurality of pieces, the accommodation groove penetrates a respective one of the plurality of mounting plates from top to bottom, a side wall of each of the plurality of mounting plates is configured with a plurality of display holes in communication with the accommodation groove, the baffle is slidably arranged at a bottom of a lowermost mounting plate of the plurality of mounting plates along a horizontal direction to receive the plurality of pieces, a plurality of light emitting diodes (LEDs) are embedded inside the baffle, the plurality of LEDs are arranged at intervals along the horizontal direction, a gravity sensor is fixedly disposed on a surface of the baffle, the gravity sensor is configured to contact the plurality of pieces, and the gravity sensor is electrically connected to the plurality of LEDs.

* * * * *